US005372117A

United States Patent [19]

Denz et al.

[11] Patent Number: 5,372,117

[45] Date of Patent: Dec. 13, 1994

[54] METHOD AND ARRANGEMENT FOR VENTING A TANK

[75] Inventors: Helmut Denz, Stuttgart; Ernst Wild, Oberriexingen; Andreas Blumenstock, Ludwigsburg, all of Germany

[73] Assignee: Robert Bosch GmbH, Stuttgart, Germany

[21] Appl. No.: 119,144

[22] PCT Filed: Mar. 21, 1992

[86] PCT No.: PCT/DE92/00127

§ 371 Date: Sep. 22, 1993

§ 102(e) Date: Sep. 22, 1993

[87] PCT Pub. No.: WO92/16734

PCT Pub. Date: Oct. 1, 1992

[30] Foreign Application Priority Data

Mar. 22, 1991 [DE] Germany ..... 4109401

[51] Int. Cl.[5] ..... F02M 25/08; F02D 41/14

[52] U.S. Cl. ..... 123/698; 123/520

[58] Field of Search ..... 123/698, 519, 520

[56] References Cited

U.S. PATENT DOCUMENTS

| | | | |
|---|---|---|---|
| 4,467,769 | 8/1984 | Matsumura | 123/698 |
| 4,705,007 | 11/1987 | Plapp et al. | 123/519 |
| 5,048,493 | 9/1991 | Orzel et al. | 123/698 |
| 5,085,194 | 2/1992 | Kuroda et al. | 123/698 X |
| 5,125,385 | 6/1992 | Frinzel | 123/698 |
| 5,150,689 | 9/1992 | Yano et al. | 123/520 X |
| 5,193,512 | 3/1993 | Steinbrenner et al. | 123/520 X |
| 5,265,577 | 11/1993 | Denz et al. | 123/520 |

FOREIGN PATENT DOCUMENTS

| | | |
|---|---|---|
| 0191170 | 8/1986 | European Pat. Off. . |
| 0208069 | 1/1987 | European Pat. Off. . |
| 3008320 | 9/1980 | Germany . |
| 3623894 | 1/1987 | Germany . |
| 3928585 | 3/1990 | Germany . |
| 60-8458 | 1/1985 | Japan . |
| 60-65245 | 4/1985 | Japan . |
| WO90/00225 | 1/1990 | WIPO . |

*Primary Examiner*—Willis R. Wolfe
*Attorney, Agent, or Firm*—Walter Ottesen

[57] ABSTRACT

A method for alternately carrying out phases with and without tank venting during operation of an internal combustion engine equipped with a tank-venting assembly is characterized in that the ratio of the time spans with and without tank venting is selected to be dependent upon operating data of the engine or of the tank-venting assembly. Preferably, a variable is measured which is a measure for the fuel quantity to be regenerated during tank venting and the above-mentioned ratio is increased in favor of the tank-venting time span with respect to the base ratio when the value of the measured variable exceeds an upper limit (Dp_SMW; FTEA_SWU). This method makes possible that an adsorption filter and a tank-venting valve in the corresponding arrangement can be dimensioned for lesser throughput quantities than previously without the danger being present that fuel vapors escape to the ambient. The tank-venting time span is extended with respect to the base-adaptation time span when a large amount of fuel vapor occurs whereby the smaller adsorption filter still regenerates satisfactorily notwithstanding the reduced cross section of the tank-venting valve.

14 Claims, 5 Drawing Sheets

METHOD AND ARRANGEMENT FOR VENTING A TANK

FIELD OF THE INVENTION

The invention relates to a method and an arrangement for alternately carrying out phases with and without tank venting during operation of an internal combustion engine equipped with a tank-venting assembly.

BACKGROUND OF THE INVENTION

U.S. Pat. No. 4,705,007 describes a method according to which phases with and without tank venting (namely, tank-venting phases and base-adaptation phases) alternate in a fixed raster. 5 minutes are provided for the tank-venting time span and 1 minute is provided for the base-adaptation time span. In practice, the first time duration is more likely to be somewhat shorter and the second somewhat longer.

The duration of the tank-venting time span together with the characteristic variables of the tank assembly and of the corresponding engine determine the size of the adsorption filter in which fuel vapor is adsorbed from the tank. These variables also determine the diameter of the tank-venting valve with the aid of which the adsorption filter is purged with air. The size of the adsorption filter and the cross section of the tank-venting valve must be so dimensioned that, even for the largest possibly occurring fuel vapor quantity, essentially all fuel vapor can be adsorbed during the base-adaptation time spans and can again be desorbed during the tank-venting time spans.

In the technology, the problem generally is present to operate arrangements according to such methods and to so configure the arrangements that the components are used in the most purposeful manner possible. This problem applied correspondingly also to methods and arrangements for carrying out phases with and without tank venting during operation of an internal combustion engine with a tank-venting assembly.

SUMMARY OF THE INVENTION

A method of the invention of this kind is characterized in that the ratio of the time spans with and without tank venting is no longer fixed; instead, the ratio is selected to be dependent upon operating data of the engine or of the tank-venting assembly.

The arrangement of the invention includes a sequence control for alternately carrying out phases with and without tank venting. The sequence control is so configured that it selects the ratio of phase durations in dependence upon operating data of the engine or of the tank-venting assembly.

The method and arrangement can use participating components with greater flexibility than was previously possible because this method and this arrangement no longer use a fixed pregiven time reference for the above-mentioned phases.

In a preferred embodiment, the method includes the following steps:

- a variable is measured which is a measure for the fuel quantity occurring during the tank venting; and,
- the ratio of the tank-venting time span to the base-adaptation time span is increased with respect to a base ratio when the value of the measured variable exceeds an upper threshold value.

According to another variation, tank venting is carried out at full load without lambda control always with a completely open tank-venting valve. This variation is based upon the recognition that no base adaptation can be carried out in the phases without tank venting during full load without lambda control so that it is more purposeful to utilize the entire time for tank venting. The valve is not used much because the valve is held continuously open in lieu of being clocked.

According to a third variation, a diagnostic method is started to determine the operability of the tank-venting assembly during a tank-venting phase. The diagnostic method requires a temporary closure of the tank-venting valve. Immediately with the closing of the valve, a base-adaptation phase is started and the next tank-venting phase is extended at least partially as compensation for the interrupted previous phase. In this way, the time for diagnosis is at the same time purposefully utilized for adaptation.

It is especially advantageous to utilize all above-mentioned variations in common.

The method having a variable ratio of the above-mentioned time spans makes possible that the adsorption filter and the tank-venting valve can be configured for the throughput of an average quantity of fuel from the tank venting in lieu of a maximum quantity. These parts are configured to be smaller than previously but are nonetheless capable to satisfactorily vent even very large quantities of fuel vapor as they occasionally occur because, in this case, the tank-venting time span is extended at the expense of the base-adaptation time span. The shortening of the base adaptation time span, for example, up to 1 minute, and the extension of the spacing between two such time spans, for example, to 15 minutes (duration of the extended tank-venting time span) leads only in exceptional cases to disadvantages, for example, for a very rapid uphill trip on a relatively steeply inclining roadway. Here, it could actually be necessary that the factor considering air density should change by 5% or more in the base adaptation in the above-mentioned time span. Since the factor cannot do this because of the blocked base adaptation, the required change in the fuel injection time spans must be taken up by the control output of the lambda control which, in principle, is possible without difficulty since the typical range of the lambda control amounts to approximately 15%. Difficulties occur for a short time during transient operations for changes between greatly different operating conditions because then only the relatively sluggish control must undertake the adaptation to the new operating condition without optimal support by means of a well adapted precontrol. Apparently, the disadvantage is present that short-term increases of the exhaust-gas output can occur during transient operations when there is an extremely high occurrence of fuel vapor in the tank venting and therewith greatly extended tank-venting time spans during the time that a very rapid and steep uphill drive takes place. All these conditions are, however, satisfied only very infrequently. However, the advantage is continuously present that a smaller adsorption filter and a smaller tank-venting valve can be used. This leads to permanent savings of fuel if only a very small savings of fuel because of the reduced weight of these parts and also a reduced output of exhaust gas. Furthermore, the energy consumption for producing and operating the parts is reduced. Accordingly, substantially greater advantages are obtained compared to the above-mentioned disadvantage which occurs only infrequently.

The quantity of fuel vapor occurring during tank venting could theoretically be most precisely detected by means of a through-flow sensor between the tank and the adsorption filter. Such a through-flow sensor would be, however, most expensive and complex when it is to function precisely. It is simpler to determine the pressure difference between the tank pressure and the ambient pressure. For this purpose, a pressure-difference sensor is required on the tank which is recommended for mounting for several reasons for modern tank-venting assemblies. The pressure-difference sensor is therefore often provided for other reasons. The greater the pressure difference measured by the sensor, the more intense the fuel in the tank vaporizes. The ratio of the tank-venting time span to the base-adaptation time span can therefore be made dependent on this pressure difference. Another very advantageous possibility is that the above-mentioned ratio can be made dependent from the tank-venting adaptation factor itself. This is namely a direct measure for the fuel vapor quantity occurring instantaneously during tank venting. However, this value is not made actual during the base-adaptation time span.

It is advantageous to extend the base-adaptation time spans at the expense of the tank-venting time spans when only little fuel vapor occurs during tank venting. In the last-mentioned time spans, the tank-venting valve is clock-driven; whereas, this valve is closed without current in the base-adaptation time spans. The valve therefore contributes significantly to the increase of the service life of the tank-venting valve when this valve is then only driven when actually required for tank venting. Another type of drive of reduced use mentioned above is that the valve is held continuously open which is possible at full load without lambda control.

The answer to the question as to how much the tank-venting time span should be extended in order to prevent an oversaturation of the adsorption filter is dependent not only upon how much fuel vapor is supplied to the filter from the tank, but also on how well the filter can be purged in a particular operating state. In idle, and at low loads, a pressure at the output of the tank-venting system is so low that the quantity of purging gas must be limited by a partial closure of the tank-venting valve (corresponding to the pulse-duty factor). In contrast, at very high load, and especially at full load, the purging effect is somewhat low even for a completely opened tank-venting valve. It is therefore advantageous to not only increase the tank-venting time span for increasing quantities of fuel vapor supplied to the adsorption filter but also during increasing load, that is, reduced purging action.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
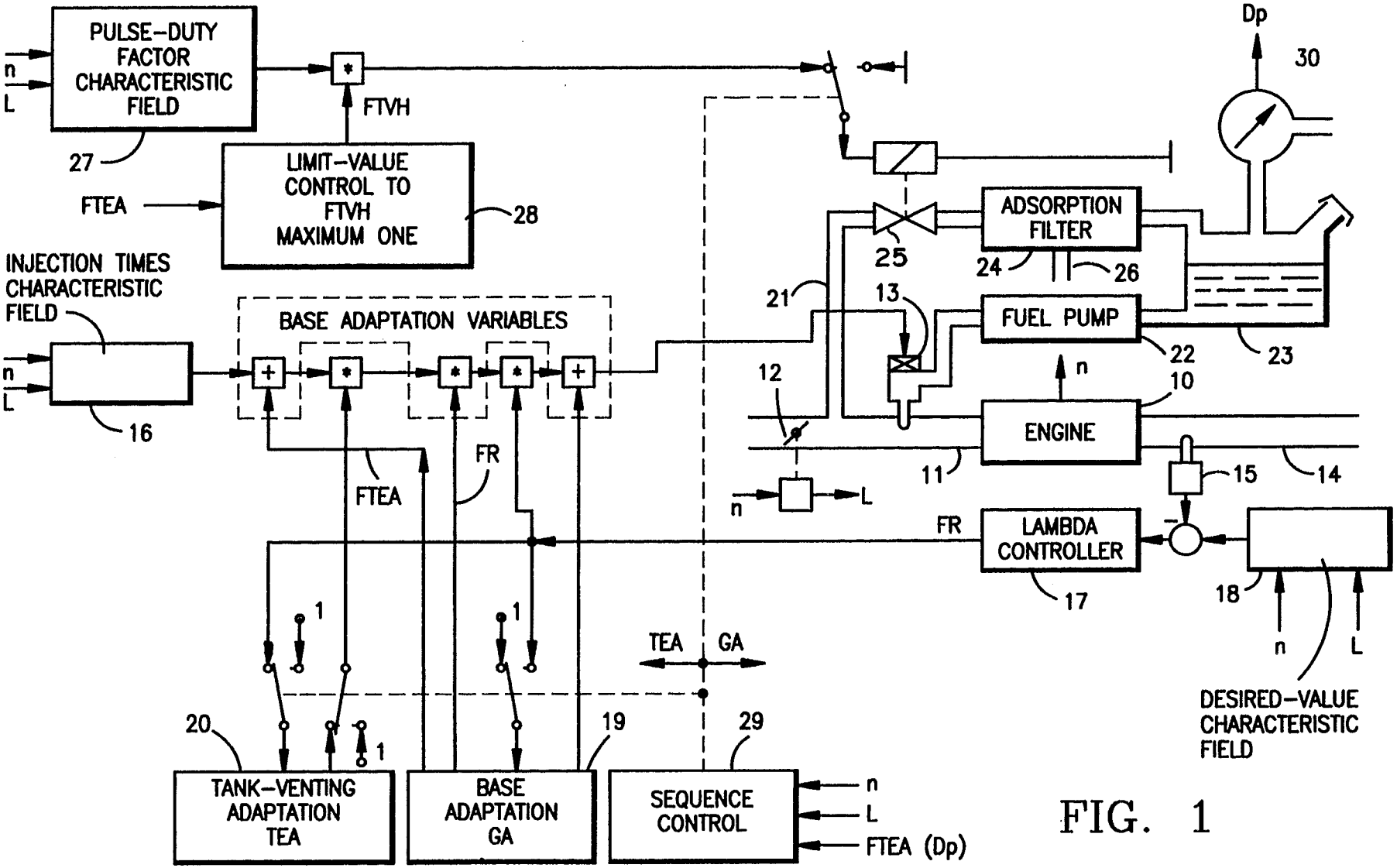
FIG. 1 is a block diagram of an internal combustion engine having a fuel-venting assembly and lambda control as well as function groups for tank-venting adaptation and base adaptation.

FIG. 1 shows an internal combustion engine 10 having an intake pipe 11 in which a throttle flap 12 and an injection valve 13 are mounted and an exhaust gas pipe 14 in which a lambda probe 15 is arranged. The injection times with which the injection valve 13 is driven are determined by adapted precontrol with lambda control. For this purpose, injection times are read out of an injection-time characteristic field 16 in dependence upon rotational speed n and load L and are logically combined with adaptation variables and a control factor FR. The control factor FR is made available by a lambda controller 17 which forms this factor on the basis of a control algorithm starting from a control deviation as this deviation corresponds to the difference between a lambda desired value read out of a desired value characteristic field 18 and the lambda actual value supplied by the lambda probe 15. The control factor FR, that is the control output of the lambda control, is the basis for the adapted values as they are formed by a base-adaptation unit 19 and a tank-venting adaptation unit 20. The base-adaptation unit 19 here computes various corrective variables in any desired known manner. In FIG. 1, three variables, which are not described in greater detail, are shown for the base adaptation. Here, the first variable can adapt additive leakage-air defects, the second variable can compensate for multiplicative changes in air tightness and the third variable can adapt additive pull-in time and release time changes of the injection valve 13. The tank-venting adaptation unit 20 makes available: a multiplicatively operating factor FTEA for the tank venting which has the value one during a non-operating tank venting, and, in contrast, in the case of an operating tank venting, has an adaptive value greater or less than one in dependence upon whether the tank venting supplies a leaner or a richer mixture to the intake pipe than is provided during the mixture formation without tank-venting adaptation.

As mentioned above, fuel can be supplied to the internal combustion engine 10 in two ways, namely, either via the injection valve 13 or via a venting line 21 of a tank-venting assembly. The injection valve 13 receives its fuel via a fuel pump 22 from a tank 23. This tank 23 is vented via an adsorption filter 24, a tank-venting valve 25 and the venting line 21. As long as the tank-venting valve 25 is closed, fuel vapor emanating from the tank 23 collects in the adsorption filter 24. Base adaptation takes place during this time. The tank-venting adaptation unit 20 receives the value one as the input value which has as a consequence that no adaptation is carried out. The tank-venting adaptation unit 20 emits the value one as a tank-venting factor FTEA.

As soon as the tank-venting valve 25 is opened, the underpressure present in the venting line 21 acts in the adsorption filter 24 whereupon this filter draws purging air through a venting line 26. This air desorbs fuel held in the adsorption filter and conducts the same to the intake pipe 11. Tank-venting adaptation is undertaken in this phase. For this purpose, the tank-venting adaptation unit 20 receives the output signal FR from the lambda controller and emits the tank-venting adaptation factor FTEA. The base-adaptation unit 19 receives the value one as input value during this tank-venting time span. In this way, the base adaptation variables remain unchanged which continue to be emitted corresponding to their last state.

The tank-venting valve 25 is not necessarily completely open in the tank-venting time spans. Rather, it is, as a rule, driven with a specific pulse-duty factor which is read out of a pulse-duty factor characteristic field 27 in dependence upon engine speed n and load L. The pulse-duty factors are so dimensioned that a maximum air quantity can pass through the tank-venting valve 25. At idle, this quantity is relatively greatly limited; whereas, at full load, the tank-venting valve is completely opened. When the adsorption filter 24 is completely regenerated, the pulse-duty factor TVH, which is read out of the pulse-duty factor characteristic field 27, remains unchanged. Otherwise, the pulse-duty factor TVH would be reduced with the aid of a limit-value control 28 in dependence upon the value of the tank-venting factor FTEA. The limit-value control emits a factor FTVH which maximally assumes the value one. The richer the mixture sup,plied from the tank-venting line 21 into the intake pipe 11 is, the more the pulse-duty factor TVH, which is read out of the pulse-duty factor characteristic field 27, is reduced with the aid of the above-mentioned factor FTVH.

The switchover between base adaptation GA and tank-venting adaptation TEA takes place with the aid of a sequence control 29.

The arrangement described to this extent corresponds completely with an embodiment of a conventional arrangement. The difference is in the specific configuration of the sequence control 29. In known methods and arrangements, the sequence control is based on fixed values for the base-adaptation time span and the tank-venting time span for alternately carrying out base adaptation GA and tank-venting adaptation TEA. The base-adaptation time span and the tank-venting time span are typically 1.5 minutes and 4 minutes, respectively. However, with the invention, the sequence control 29 varies the ratio of tank-venting time span to base-adaptation time span in dependence upon the fuel quantity occurring during the tank venting.

A direct measure for the fuel vapor quantity occurring during tank venting is the value of the tank-venting adaptation factor FTEA. When this value indicates a very rich tank-venting mixture, the tank-venting time span is extended and the base-adaptation time span is shortened. An opposite change of the above-mentioned time spans takes place in the opposite case. It should however be noted that, when selecting the variable FTEA as a measure for the fuel quantity occurring during tank venting, the base-adaptation time span cannot be selected to be too long since the variable FTEA is not actualized in this time and therefore it is unknown whether too much or too little fuel has collected in the adsorption filter 24.

Very large base-adaptation time spans can however be selected when as a measure for the fuel quantity to be regenerated, the pressure difference between the internal pressure of the tank 23 and the atmospheric pressure is used. For this purpose, a difference pressure sensor 30 is connected to the tank. The signal of the sensor 30 is supplied to the sequence control 29. The difference pressure is a direct indication as to whether more or less fuel has vaporized and accordingly is an indication as to how much fuel is to be regenerated. If the pressure difference at first was very low and therefore a long base-adaptation time span had been selected, and nonetheless an increase of the pressure difference is observed during this time span, the base adaptation can be interrupted and tank venting can be carried out.

It will now be described with respect to FIG. 2 as to how the base-adaptation time span T_GA and the tank-venting time span T_TEA can be selected in dependence upon values of the difference pressure Dp. In a step s2.1, a check is first made as to whether Dp is less than a lower threshold value Dp_SWU. If this is the case, then in step s2.2, an extended base-adaptation time span of 10 minutes and a usual tank-venting time span of 4 minutes is set. Otherwise, an inquiry is made in step s2.3 as to whether Dp is less than a mean threshold value Dp_SWM. If this is the case, then conventional time spans are selected as they are shown in a step s2.4 in FIG. 2. Otherwise, an inquiry is made in step s2.5 as to whether the difference pressure Dp is below a high threshold value Dp_SWH. If this is the case, then in step s2.6, the base-adaptation time span is shortened to 1 minute anti the tank-venting time span is extended to 6 minutes. Otherwise, that is for very high difference pressure, the tank-venting time span is lengthened still further in a step s2.7, namely, to 15 minutes. The base-adaptation time span however remains at 1 minute. In the embodiment, this is the shortest time span within which the base adaptation can still be purposefully carried out.

Figure 3:
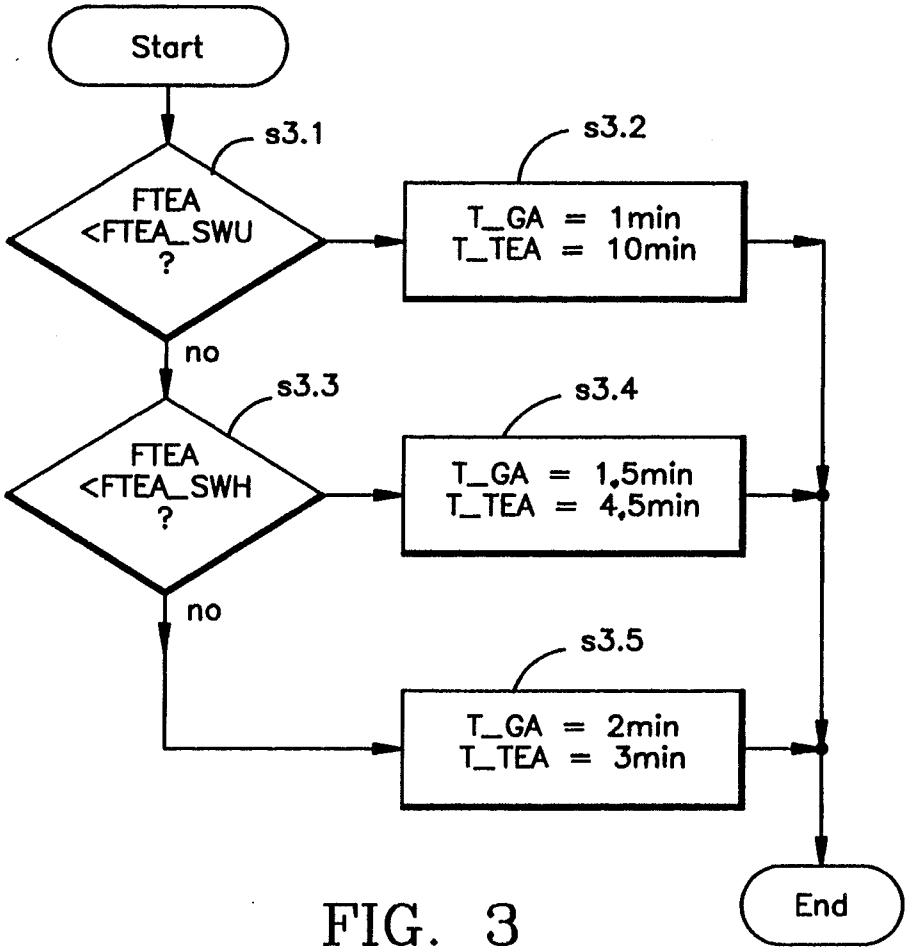
FIG. 3 is a flowchart corresponding to that of FIG. 2 but for an additional reduction of the ratio between tank-venting time span and base-adaptation time span with the change of the ratio taking place on the basis of the tank-venting adaptation factor.

FIG. 3 shows a similar procedure when, in lieu of the pressure difference Dp, the tank-venting adaptation factor FTEA is used as a measure for the quantity of fuel to be regenerated during the tank venting. Differences are that in the last case the base-adaptation time span must not be extended for a reason given above and that the above-mentioned factor is reduced with increasingly greater fuel quantity while the pressure difference in this case is greater. This leads to changed inquiries.

In a step s3.1, a check is made as to whether the value of FTEA is less than a lower threshhold FTEA_SWU. If this is the case, then the base-adaptation time span is shortened to the minimum value of 1 minute in a step s3.2 and the tank-venting time span is extended to 10 minutes. Otherwise, in step s3.3, an inquiry is made as to whether the value of FTEA lies bellow a high threshold FTEA_SWH. If this is the case, then in step s3.4, the usual time spans are set which define the base ratio of the tank-venting time span to the base-adaptation time span. Otherwise, in step s3.5, the tank-venting time span is shortened to 3 minutes whereas the base-adaptation time span is increased slightly to 2 minutes. A larger extension is not acceptable since the value FTEA is not actualized during the base-adaptation phases and it is therefore unclear as to whether the fuel quantity to be regenerated has changed.

Figure 2:
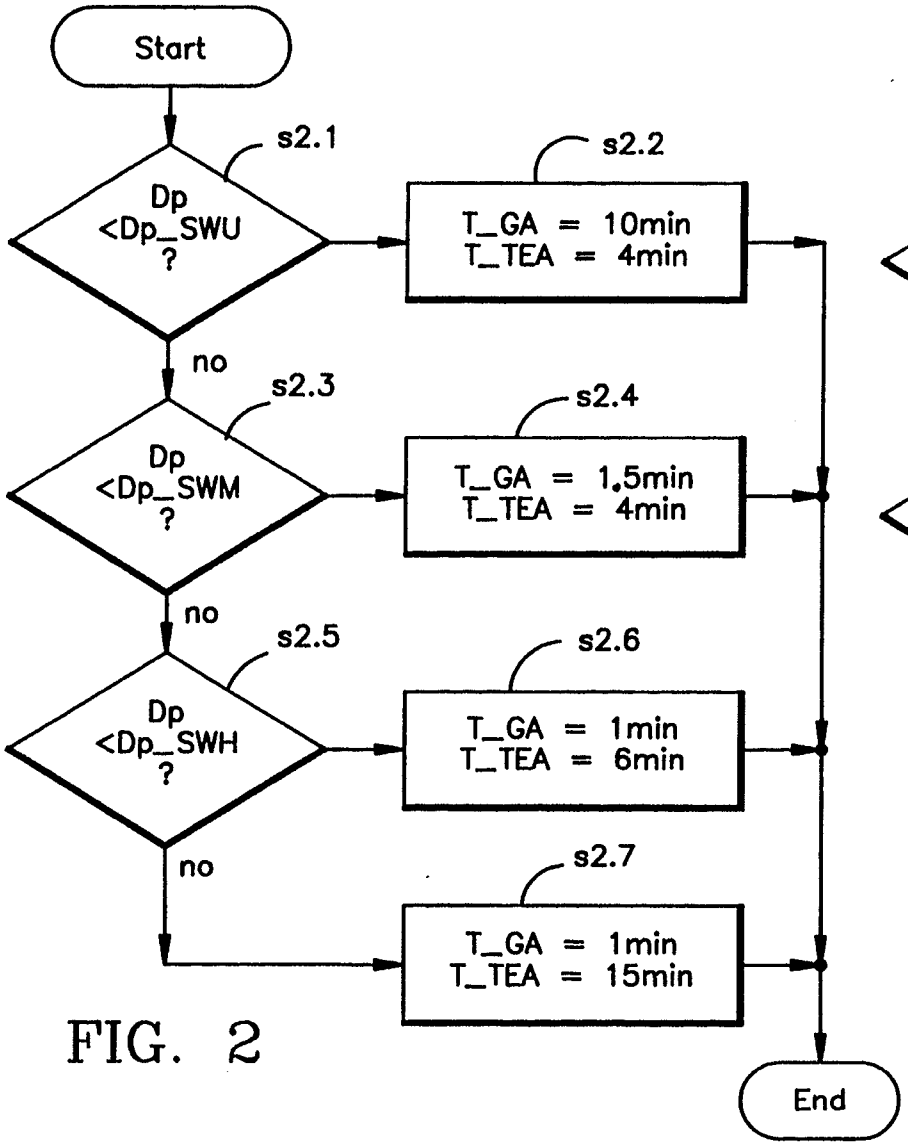
FIG. 2 is a flowchart for explaining a procedure to increase the tank-venting time span at the expense of the base-adaptation time span based on a difference-pressure signal.

It is especially advantageous to combine the two procedures described with respect to FIGS. 2 and 3 in that the ratio of the tank-venting time span to the base-adaptation time span is actually set with the aid of the precise value FTEA; that, however, in the extended base-adaptation time spans, a check is made with the aid of the difference pressure Dp as to whether the base adaptation should be interrupted because of increasing vaporized fuel quantity.

Figure 4:
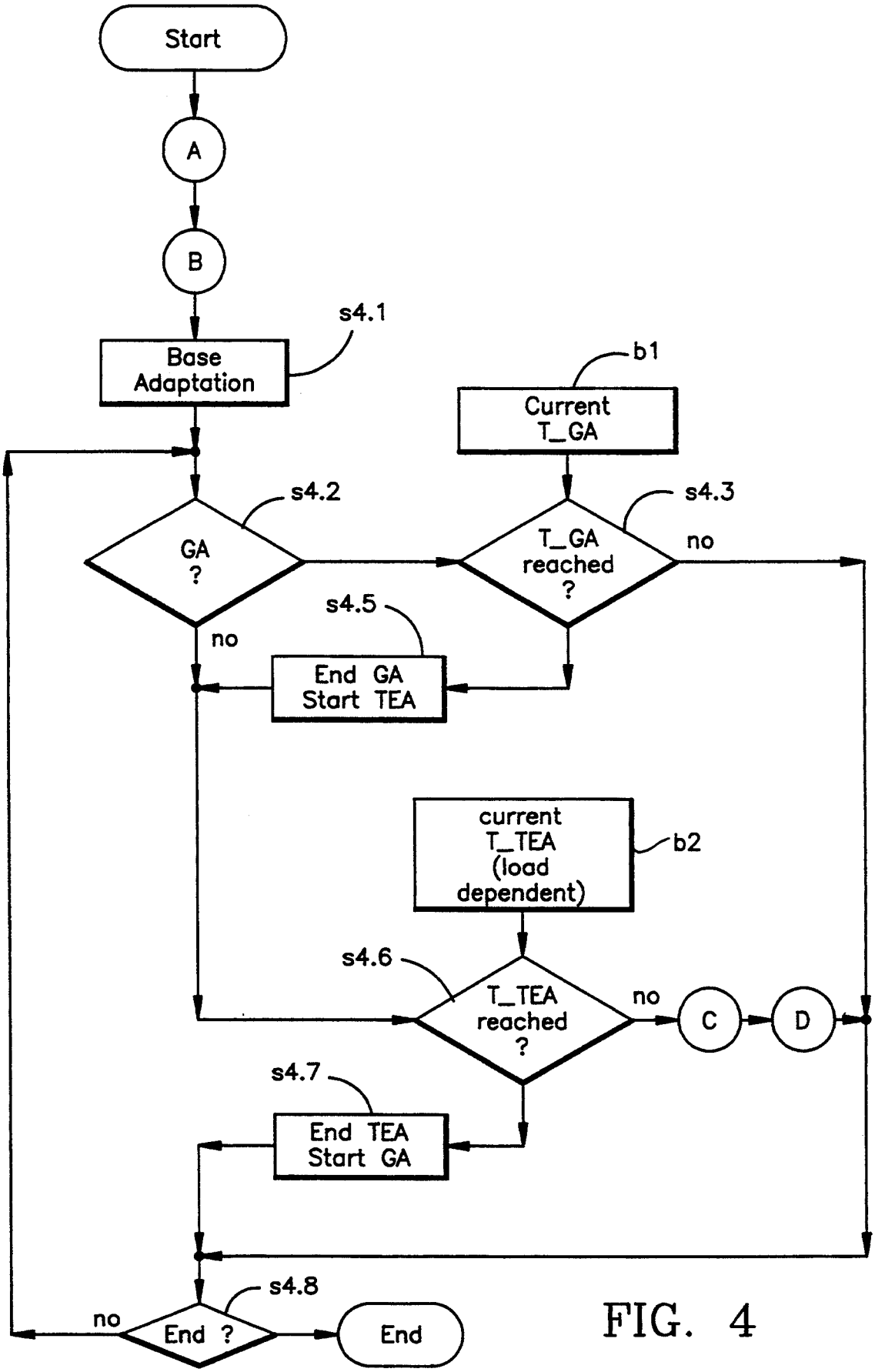
FIG. 4 is a flowchart for explaining the method for alternately carrying out the base adaptation and the tank-venting adaptation.

FIG. 4 shows how the change of base-adaptation phases and tank-venting phases can be controlled. In a step s4.1, the base adaptation is first started after running through two marks A and B (see also FIG. 5 for this purpose). In a next step s4.2, an inquiry is made as to whether base adaptation is just then taking place. Since this is the case after the start of the method, a check is made as to whether the base-adaptation time span T_GA has already run (step s4.3). The information for the actual time span T_GA is supplied from a block b1. This time span has not yet elapsed shortly after the start of the method whereupon a step s4.8 follows step s4.3. In step s4.8, the inquiry is made as to whether the method should be ended. This is not yet the case whereupon the sequence repeats starting with step s4.2. If after a time it is determined in step s4.3 that the actual value of the base-adaptation time span T_GA is reached then, in step s4.5, the base adaptation GA is ended and the tank-venting adaptation TEA is started. Thereafter, a check is made (step s4.6) as to whether the actual tank-venting time span T_TEA has already run. The value of this time span is made available from a block b2. If the time has not yet elapsed, the steps s4.8, s4.2 and s4.6 repeat after running through two marks C and D (see also FIG. 6 for this purpose). This run-through is continued until the time span T_TEA has elapsed. Then the tank-venting adaptation is ended and the base adaptation is again started (step s4.7). If necessary, the described sequence starting with step s4.2 is again repeated after step s4.8 of the inquiry of the end of the method.

The current values of T_GA and T_TEA as they are read out of blocks b1 and b2, respectively, are determined in accordance with one of the methods explained with respect to FIGS. 2 and 3. For the time span T_TEA, there is indicated in parentheses in block b2 that this variable can be selected so as to be in addition dependent upon load. This considers the fact that, at high loads, only a slight pressure difference exists between venting line 21 and ventilating line 26 at the adsorption filter 24 so that the filter is only slightly regenerated. It is now assumed that a constant difference pressure is measured by the difference pressure sensor 30. The fuel vapor quantity occurring at this mean difference pressure can be better regenerated at average loads than at high loads. It is therefore advantageous that the ratio of the tank-venting time span to the base-adaptation time span is not only selected to be dependent upon difference pressure Dp but also dependent upon engine speed n and load L. The load condition is however of less significance when the above ratio is set with the aid of the tank-venting adaptation factor FTEA. If at first at higher loads only too little is regenerated, then this leads to a reduction of the factor FTEA which results automatically in an extension of the tank-venting time span.

it is noted that there are many strategies for base adaptation and tank-venting adaptation. What is important in the method described above and the arrangement described above is however completely independent of the particular adaptation method. What is alone decisive is that the time spans for the adaptations, irrespective of how they are executed, are dependent on the value of a variable which is a measure of the fuel quantity to be regenerated during tank venting and which time spans can be dependent furthermore upon the load state of the internal combustion engine provided with adaptation.

Figure 5:
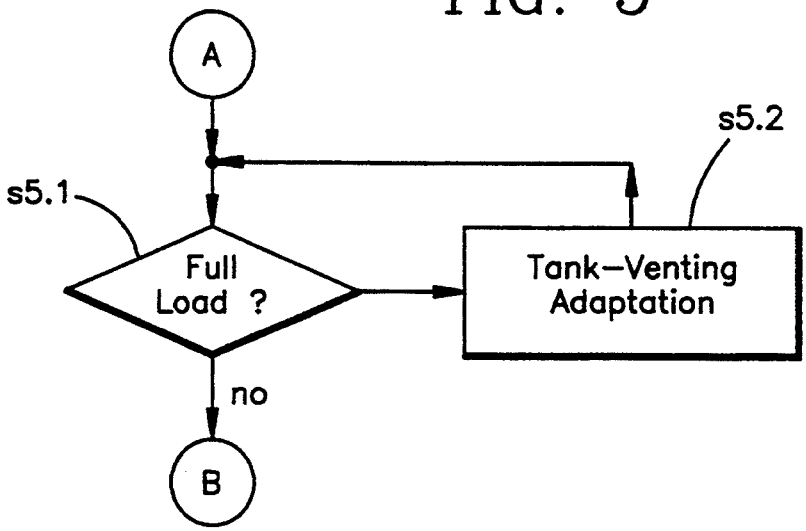
FIG. 5 is a flowchart for explaining a method for exclusively carrying out tank venting at full load.

FIG. 5 shows an embodiment as it can be used independently or also between the marks A and B in the sequence of FIG. 4. A check is made as to whether full load is present (step s5.1). If this is the case, then tank venting is carried out (step s5.2) and step s5.1 is repeated until the result is there obtained that the inquired condition is no longer satisfied. This procedure is based on the recognition that at full load for engines having lambda control, this lambda control is generally switched off and for this reason, no base adaptation can be carried out. Accordingly, it is not purposeful to interrupt the tank venting which at full load in any event does not operate too effectively.

Figure 6:
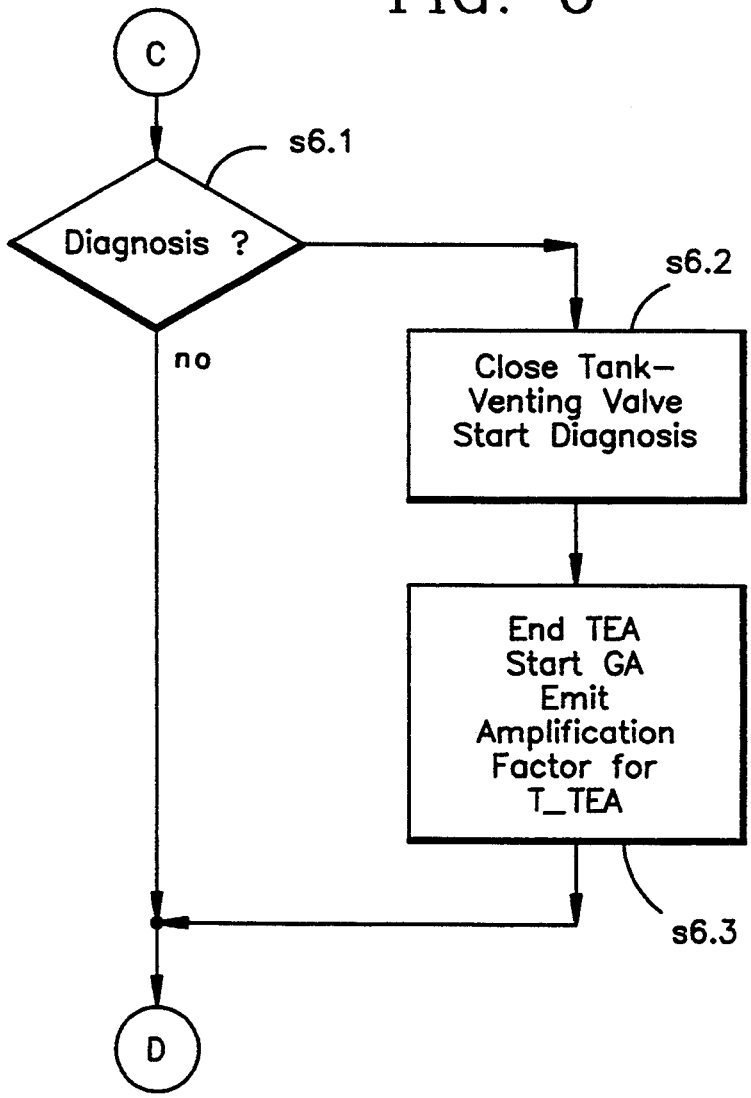
FIG. 6 is a flowchart for explaining a method for starting the base adaptation directly with closure of the tank-venting valve during a tank-venting phase for diagnostic purposes; and, FIG. 7 is a flowchart for explaining a method for starting the tank-venting phase after transient oscillations of the base adaptation.

FIG. 6 shows an embodiment as it can be used independently or also between the marks C and D in the sequence of FIG. 4. A check is made (step s6.3) as to whether a tank assembly diagnosis should be carried out for a closed tank-venting valve. A method of this kind is described in a parallel application. According to this method, the tank-venting valve is closed after a buildup of underpressure at the adsorption filter in order to obtain a conclusion as to the operability of the assembly from the time trace of the decay of the underpressure which then results. The closure of the valve and the diagnosis are subject matter of step s6.2 in FIG. 6. The tank-venting phase is ended with the closure of the valve and an adaptation phase is started and an amplification factor for the next tank-venting time span is emitted (step s6.3). The advantage of this measure has already been presented above. The amplification factor has the value two in the embodiment. For a common application with obtaining a reference quantity according to the sequence of FIG. 3, it is purposeful to limit the maximum tank-venting time span as it is obtained by multiplication by the amplification factor for the reasons explained in connection with FIG. 3.

Figure 7:
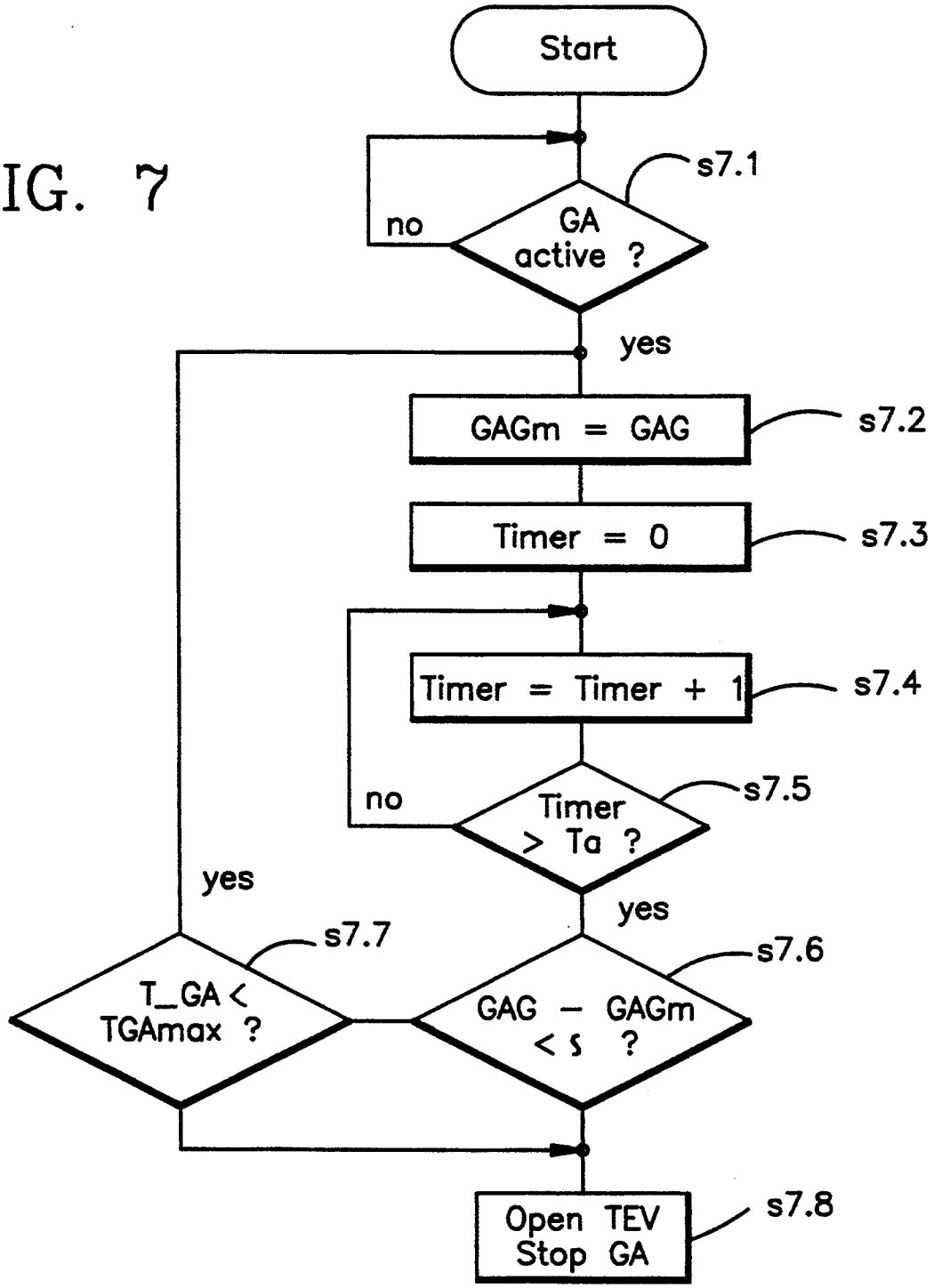

FIG. 7 shows an embodiment wherein, after the start of the internal combustion engine (combustion engine) a delay is first had until the transients have subsided. If this is the case, then the tank-venting valve is continuously opened.

For this purpose, an inquiry is made in a step s7.1 after the start of the engine as to whether the base adaptation (GA) is active. A condition precedent therefor is for example the operational readiness of the lambda control. Only with active base adaptation, a step s7.2 follows, in which the value of the base-adaptation variable GAG is intermediately stored as value GAGm with said value GAG being just then current. The step s7.3 operates to reset a timer to the value zero. In the step sequence s7.4, s7.5 which follows, the value of the variable timer increases until in s7.5, the threshold value Ta is exceeded. At this time point, the current value GAG of the base adaptation variable is compared to the intermediately stored value GAGm in the step s7.6. If the difference of the two values is greater than a threshold value S, then the transients associated with base adaptation are not yet over and a start is made again with step s7.2 via a step s7.7. The loop of steps s7.2 to s7.6 is run through so long until the difference GAG-GAGm has become less than the threshold value S. In other words, the loop is run through until the base adaptation transients are over. The subsequent step s7.8 operates to continuously open the tank-venting valve TEV when base adaptation has been stopped.

After this sequence, the base adaptation is carried out only once during a drive cycle and thereafter the adsorption filter is permanently purged for opened TEV.

An additional interrupt condition is checked in step s7.7. According to this step and after a maximum base-adaptation time span TGmax has elapsed, an opening of the tank-venting valve likewise occurs. This function assures that also for defective base adaptation, in each case, the TEV is opened.

In this case, a still further base-adaptation phase follows after a tank-venting phase (approximately 1 min).

We claim:

1. An arrangement for tank venting in an internal combustion engine, the arrangement comprising:

a tank-venting assembly including a tank; storage means for storing fuel vapors generated in said tank; conduit means for conducting said vapors to and away from said storage means; and, a tank-venting valve mounted in said conduit means for opening and closing said conduit means;

an apparatus for controlling the fuel/air ratio lambda; the apparatus including: a lambda probe for supplying a signal; a controller for receiving said signal and for forming a control output (FR) for influencing the fuel/air mixture to be supplied to said engine; means for providing a correction to adaptively influence the composition of the fuel/air mixture; and, switching means for switching between a first phase wherein said tank-venting valve is opened for venting said tank and a second phase wherein said tank-venting valve is closed and the base adaptation is carried out; and, said switching means being adapted to determine the time duration of said phases in dependence upon characteristic variables of at least one adaptive correction or upon characteristic variables of said tank-venting assembly.

2. The arrangement of claim 1, wherein said characteristic variables of said at least one adaptive correction include base adaptation (GA) and tank-venting adaptation (TEA).

3. The arrangement of claim 1, wherein one of said characteristic variables of said tank-venting assembly is the pressure difference (Dp) between the tank pressure and the ambient pressure.

4. A method for tank venting in an internal combustion engine having a tank-venting arrangement which includes a tank and a tank-venting assembly having a tank-venting valve which can be opened and closed for venting the tank, the engine further including a control arrangement for controlling the fuel/air ratio lambda, the control arrangement including a lambda probe for supplying a lambda signal and a controller for receiving the lambda signal and for forming a control output FR for influencing the fuel/air mixture supplied to the engine; the control arrangement further including means for providing a correction in the form of a base adaptation variable (GAG) to adaptively influence the composition of said fuel/air mixture, the method comprising the steps of:

switching between a first phase wherein said tank-venting valve is opened for venting said tank and a second phase wherein said tank-venting valve is closed and the base adaptation is carried out; and, selecting the time duration of said first and second phases in dependence upon at least one of the following variables: base adaptation variable (GAG); an additional adaptation (FTEA) carried out while said tank-venting valve is open; and, operating data of said tank-venting assembly.

5. The method of claim 4, further comprising the step of: at full load without lambda control, continuously venting the tank with said tank-venting valve completely opened.

6. The method of claim 4, further comprising the step of: when the tank-venting valve is closed for diagnostic purposes during a tank-venting phase, immediately starting a base-adaptation phase for the lambda control and extending the next tank-venting phase.

7. The method of claim 4, further comprising the steps of: after the start of the engine, carrying cut the base-adaptation phase until this base adaptation has reached steady state; and thereafter, opening the tank-venting valve.

8. The method of claim 4, further comprising the steps of:

monitoring the change of the base-adaptation value during the base-adaptation phase; and, determining the base adaptation to have reached steady state when the change of the base-adaptation value drops below a threshold value.

9. The method of claim 4, further comprising the steps of:

measuring a variable to obtain a reference quantity for the quantity of fuel to be regenerated during tank venting; and, increasing the ratio of the time spans with and without tank venting in favor of the time span with venting relative to a base ratio when the fuel quantity in accordance with said reference quantity exceeds an upper limit.

10. The method of claim 9, further comprising the step of lowering said ratio lambda relative to said base ratio when the fuel quantity in accordance with said reference quantity drops below a lower limit.

11. The method of claim 10, further comprising the steps of:

reducing the time span without venting (T_GA) only up to a pregiven minimum value when said ratio lambda is increased; and, causing said ratio lambda to increase further by extending the tank-venting time span (T_TEA).

12. The method of claim 11, wherein the variable measured is the pressure difference (Dp) between the tank pressure and the ambient pressure.

13. The method of claim 11, wherein the variable measured is the tank-venting adaptation factor (FTEA).

14. The method of claim 11, further comprising the step of extending the tank-venting time span (T_TEA) more at higher load than at lower load.

* * * * *

UNITED STATES PATENT AND TRADEMARK OFFICE

CERTIFICATE OF CORRECTION

PATENT NO. : 5,372,117

DATED : December 13, 1994

INVENTOR(S) : Helmut Denz, Ernst Wild and Andreas Blumenstock

It is certified that error appears in the above-identified patent and that said Letters Patent is hereby corrected as shown below:

On the title page, under "PCT Filed", item [22]: delete "Mar. 21" and substitute -- Feb. 21 -- therefor.

In column 4, line 47: after "available", delete -- : --.

In column 5, line 33: delete "sup,plied" and substitute -- supplied -- therefor.

In column 6, line 32: delete "anti" and substitute -- and -- therefor.

In column 7, line 64: delete "it" and substitute -- It -- therefor.

In column 9, line 10: delete "TGmax" and substitute -- TGAmax -- therefor.

In column 10, line 24: delete "cut" and substitute -- out -- therefor.

Signed and Sealed this

Twenty-first Day of March, 1995

*Attest:*

Bruce Lehman

BRUCE LEHMAN

*Attesting Officer*

*Commissioner of Patents and Trademarks*